United States Patent [19]

Havens

[11] Patent Number: 5,052,262

[45] Date of Patent: Oct. 1, 1991

[54] CYMBAL TILT ADJUSTMENT MECHANISM

[76] Inventor: Richard J. Havens, 785 Monroe St., Reno, Nev. 89509

[21] Appl. No.: 533,556

[22] Filed: Jun. 5, 1990

[51] Int. Cl.[5] ..... G10D 13/02; G10D 13/06

[52] U.S. Cl. ..... 84/421; 84/422.3

[58] Field of Search ..... 84/421, 422.3; 284/158, 284/371; 74/424.8 R, 89.15

[56] References Cited

U.S. PATENT DOCUMENTS

| | | | |
|---|---|---|---|
| 2,868,030 | 1/1959 | Forwald | 74/424.8 |
| 4,185,808 | 1/1980 | Donohoe et al. | 84/421 |
| 4,719,816 | 1/1988 | Carlnäs | 74/89.15 |

*Primary Examiner*—L. T. Hix
*Assistant Examiner*—Eddie C. Lee
*Attorney, Agent, or Firm*—Sughrue, Mion, Zinn, Macpeak & Seas

[57] ABSTRACT

A generally rectangular clamp body is provided with a vertical bore sized to and receiving the upper end of a cymbal stand vertical tube which coaxially supports a lower cymbal for tilting on the upper end of the vertical tube. A radial slot is provided within the clamp body to one longitudinal side of the clamp body and socket head cap screws mounted to one section of the body at the slot, engage tapped bores within the other section to reduce the gap at the slot and frictionally clamp the clamp body to the tube. The clamp body includes a rectangular cavity to the longitudinal side of the body remote from the socket head cap screws which slidably mounts, by a dovetail slot within a back plate and a dovetail projection of said sliding block, the sliding block for vertical movement over the vertical height of the cavity. A lead screw mounted for rotation within the clamp body has a threaded peripheral portion threadably engaged with a tapped hole within the sliding block. A thumb knob projecting externally of the clamp body and fixed to the lead screw permits rotation of the lead screw about its axis. A probe fixed to the sliding block and projecting outwardly of the top of the clamp body contacts the lower cymbal to one side of its vertical axis to effect tilting of the lower cymbal upon rotation of the thumb knob.

7 Claims, 1 Drawing Sheet

CYMBAL TILT ADJUSTMENT MECHANISM

FIELD OF THE INVENTION

This invention relates to high-hat cymbals and more particularly to a mechanism mounted to the top of the vertically upright cymbal stand for adjusting the tilt angle of the lower cymbal and for maintaining that tilt angle during extensive play of the instrument.

DESCRIPTION OF THE PRIOR ART

The high-hat cymbal is a percussive musical instrument which requires a vertically upright stand upon which resides a pair of oppositely facing concave cymbals. The upper cymbal is lifted away from the lower cymbal and is permitted to fall by gravity. If the bottom cymbal is horizontal, the drop of the upper cymbal onto the lower cymbal creates a vacuum therebetween and no sound is produced.

High-hat stands are often provided therefore with support means for the lower cymbal which enables the lower cymbal to be tilted with respect to the upper cymbal for particular desired musical effects. Adjustment of the angle of inclination of the lower cymbal with respect to the face of the upper cymbal involves the use of a cymbal adjustment mechanism or assembly. Such symbol supporting and tilting assemblies have a tendency to be not only difficult to adjust during use in the musical performance, but, over time tend to slip resulting in a significant change in sound.

U.S. Pat. No. 4,381,690 issued May 3, 1983. entitled "Cymbal Stand" to Thomas E. Kimbal teaches a cymbal stand which includes as an element thereof a support and tilting assembly utilizing as the major components a base member, an adjustment ring, a support or tilter plate, a compression spring and a resilient washer. By rotation of the adjustment ring about the vertical axis relative to the abutting tilter plate, a lug rides along an annular ramp of the adjustment ring to vary the inclination of the lower cymbal from a horizontal position with the lower cymbal resting on the felt washer.

U.S. Pat. No. 4,528,888 issued July 16. 1985 entitled "Adjustable Stand for Step- and High-hat Cymbal" to Yoshihiro Hoshino, employs an adjusting nut or bolt on a support body for moving the holding rod for the top cymbal to adjust the pressure on the cymbals in the closed state.

U.S. Pat. No. 4,458,574 issued July 10, 1984 and entitled "Cymbal Support for High-hat Cymbal" to Yoshihiro Hoshino, utilizes a clamping screw passing through an upper holding nut which presses the support rod against the internal walls of upper and lower terminal openings canting the rod in the terminal openings for locking the supporting rod to the support. The cymbal passes through a felt ring which is secured to the exterior of the bolt by the lower holding nut below and by a locking nut above which locking nut is beneath the upper holding nut. The structure forms a support and stop for the upper cymbal of a high-hat cymbal.

U.S. Pat. No. 4,517,876 issued May 21, 1985 entitled "Cymbal Support" to Dane J. Duhon, teaches a lower centrally apertured and upwardly facing cymbal being mounted from the upper end of a second tubular member for universal canting relative to the tubular member. An upstanding support rod is slidably received through the second tubular member and projects upwardly through the lower cymbal and supporting at the upper end of the rod and opposing the lower cymbal, a downwardly facing cymbal. A set screw locks the upper cymbal in its position on the reciprocating rod.

German DE 3144302 A1 published May 19, 1983, teaches mounting to a vertical tube of a cymbal stand, the lower cymbal plate. The tube contains a slidable rod which is pedal operated against a lift spring and carries the upper cymbal plate. The lower cymbal plate is supported by a collar 10 secured to the upper end of the vertical tube and the lower cymbal plate is placed in inclined position by a rotatable disk which rotates between the lower cymbal plate and support collar with the upper support face of the collar and the lower face of the disk being inclined to their respective axes.

While such apparatus as disclosed in the patents above permit adjustments in the position of the upper and lower cymbals in a high-hat cymbal assembly, and while the patents disclose in some instances mechanisms for adjustably tilting the lower cymbal, the structures are complicated, costly and the adjusted position of the lower cymbal cannot be maintained over extensive use of the musical percussive instrument.

It is therefore a primary object of the present invention to provide a high-hat cymbal tilt adjustment mechanism in which the desired angle of tilt of the lower cymbal may be effectively and quickly achieved while playing of the instrument, which will maintain the set angle of inclination during extensive playing of the instrument and which setting is unaffected by vibration set up during percussive action between the relatively movable cymbals.

DESCRIPTION OF THE PREFERRED EMBODIMENT

Figure 2:
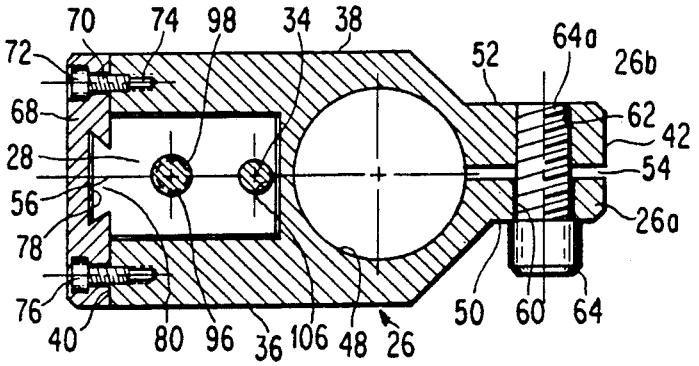
FIG. 2 is a horizontal sectional view of the mechanism of FIG. 1 taken about lines II—II.

Referring to the drawings, only a portion of a vertically upright cymbal stand and only a portion of the lower cymbal are illustrated, although reference may be had particularly to U.S. Pat. No. 4,381,690 for a more complete understanding of a high-hat cymbal, the make-up of a cymbal stand and the manner in which the two cymbals are mounted for movement relative to each other about a vertical axis to produce the desired sound.

The present invention is directed to a lower cymbal tilt adjustment mechanism which may be mounted to a cymbal stand at the upper end of a vertical hollow cymbal stand tube, upon which rests the lower cymbal and which facilitates the ready, quick and sustainable angulation of such lower cymbal. The cymbal stand indicated generally at 10 is comprised of a vertically upright tube 12, which terminates at end 12*a* in a circular disk 14. Mounted on the disk is a further disk 16 of felt upon which a flattened central portion 18*a* of a lower cymbal 18, of upwardly opened curved dish form, rests with the flat central portion 18*a* being centrally horizontal and at right angles to the vertical axis 20 of cymbal stand tube 12.

For purposes of illustration, the stand 10 further includes a vertical cylindrical rod 22 projecting through the center of the lower cymbal 18, aligned with axis 20, and permitting the lower cymbal 18 to tilt from the full line position shown with the central portion of that lower cymbal 18*a* flat and horizontal, to one as shown in dotted lines where it is slightly inclined at an angle $\alpha$ . such tilting is accomplished by the cymbal tilt adjustment mechanism indicated generally at 24 and constituting a preferred embodiment of the invention. The main components of the cymbal tilt adjustment mechanism 24 are a clamp body 26, a sliding block 28, a lead screw 30, a thumb knob 32 and a probe 34.

Clamp body 26 may be formed of metal, such as aluminum or the like, and is of modified rectangular block form having a front face 36, a rear face 38, a left side face 40 and a right side face 42, a top 44 and a bottom 46. Front and rear faces 38 and 36 are recessed to the right side, at 50 and 52, providing a narrower portion to the right than to the left. A cylindrical smooth bore hole 48 extends vertically through the clamp body 26. Circular hole 48 extends through the block adjacent lateral recesses 50 and 52 with the diameter of the hole or bore 48 being slightly larger than the external diameter of tube 12 of the cymbal stand 10. Further, an elongated, vertical slot 54 extends through the longitudinal center line 56 of the clamp body 26 from bore or hole 48 to the right side 42 of the block. This provides resiliency to the front and rear sections 26*a*, 26*b* of the block to the right of the bore hole 48. Further, horizontal holes are provided within the clamp body 26 at vertically spaced positions for both the rear section 26*b* of the body and the front section 26*a* at slot 54. Smooth bore holes 60 are formed within front section 26*a* and smaller diameter tapped holes 62, aligned respectively therewith, are formed within the rear flexible section 26*a*. Projection through the aligned bores or holes 60, 62 are the threaded shanks 64*a* of socket head cap screws 64 which couple the front and rear sections 26*a*, 26*b* of the clamp body together. By rotating the socket head a cap screw 64 clockwise, FIG. 1, the diameter of the smooth bore hole 48 may be reduced so as to effectively clamp body 26 to the hollow tube 12 of the cymbal stand 10 near the very top or upper end of that tube.

To the left side of the clamp body 26, there is provided within the left side face 40 of that block a rectangular parallelepiped cavity 66 inwardly towards vertical hole 48 aligned with the longitudinal center line 56 of the clamp body 26 and extending over a portion of the vertical height of the clamp body 26. Cavity 66 is closed off at face 40 by a flat rectangular back plate or cover 68 which is of a vertical height equal to the height of the clamp body 26 and a vertical width corresponding to the same. The back plate 68 is provided with small diameter holes 70 at the four corners which holes 70 are counter-bored at 72. Further, the clamp body 26 is provided with tapped holes 74 within vertical left side face 40 of that body at corresponding positions to the holes 70 within the back plate and, the back plate is fixedly mounted to the clamp body 26 by four socket head cap screws 76.

Figure 1:
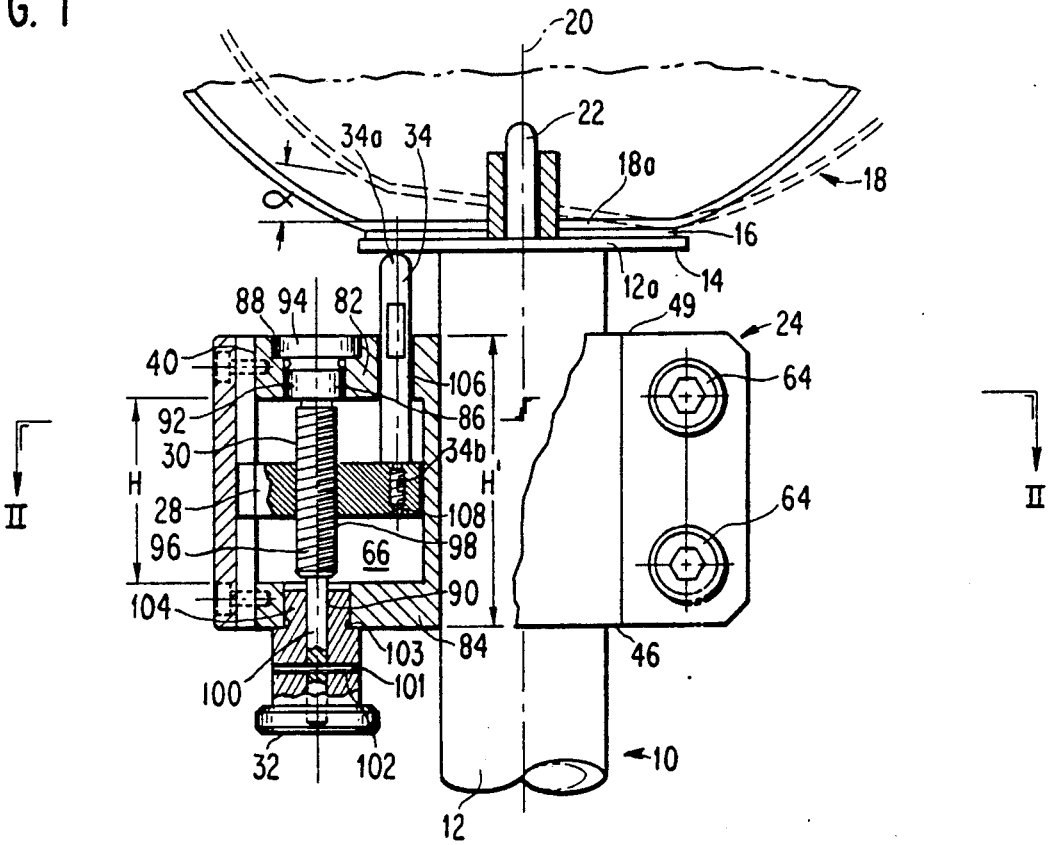
FIG. 1 is a front elevational view, partially in section, of a portion of a vertically upright cymbal stand supporting a lower cymbal for tilting relative to the vertical axis passing through the cymbal stand tube and a cymbal tilt adjustment mechanism for effecting that action and forming a preferred embodiment of the present invention.

Additionally, the rear surface of back plate or cover 68 is provided with a dovetail slot 78 extending the full vertical height of the back plate. The cavity 66 receives a sliding block 28 of generally parallelepiped form, sized slightly smaller in length and width than the cavity 66 and the sliding block has a dovetail projection 80 at its left side, which is sized slightly smaller than dovetail slot 78 receiving that projection. As such, the sliding block is maintained in its horizontal orientation as shown in FIG. 1 but may move vertically up and down within the cavity 66. The cavity 66 is of a certain vertical height H which is less than the overall vertical height H' of the clamp body 26. As such, the cavity 66 form a top wall 82 within clamp body 26 which is of a certain thickness and a bottom wall 84 which is also of a given thickness. A vertical hole or bore 86 is drilled into the top wall 82 centered with the longitudinal center line 56 of clamp body 26 and is counter-bored at 88. Further, the bottom wall 84 is provided with a smooth bore hole 90 centered with hole 86, and which may be identically sized thereto. A headed lead screw 30 of cylindrical form, has a portion 92 sized slightly smaller than the diameter of hole 86 within the top wall 82 and is positioned therein. Lead screw 30 terminates at its upper end in a radially enlarged portion or head 94 which fits within counter-bore 88 maintaining the position of that lead screw in body 26. A reduced diameter portion 96 of lead screw 30 is threaded on its outer periphery and is received within a tapped hole 98 within the sliding block such that, by rotation of the lead screw 30, the sliding block is forced to move vertically up or down, guided its dovetail projection 80 within the dovetail slot 78 within the back plate 68 over the vertical height H of the cavity 66 internally of clamp body 26. The lead screw 30 terminates in a further reduced diameter portion 100 which projects outwardly of bore 90 well beyond the bottom 46 of the clamp body 26. Thumb knob 32 is fixedly mounted to the reduced diameter portion 100 of the lead screw by way of a roll pin 101 which is inserted within a small diameter transverse hole 102 within the thumb knob 32 which hole is aligned with a similar size hole 102*a* within reduced diameter portion 100 of the lead screw 30. Further, the thumb knob 32 includes a reduced diameter portion 104 which is sized to the diameter of bore 90, thereby producing a radial shoulder 103 which abuts the bottom 46 of the clamp body to maintain the lead screw and the thumb knob in position with the lead screw threadedly meshed to the tapped bore 93 within the sliding block 28.

Further, the top 44 of the clamp body is provided with a small diameter vertical hole 106 which is of a diameter slightly larger than the diameter of elongated cylindrical probe 34, such that a spherical end 34*a* of the probe 34 projects through that hole. The lower end 34*b* of the probe is of reduced diameter and is externally threaded and fits to a small diameter tapped hole 108 within the sliding block aligned with the center line of the sliding block and the clamp body 26 supporting that sliding block for vertical movement within cavity 66. The tapped hole 108 is laterally offset from the axis of the lead screw, to the side of said sliding block opposite dovetail projection 80. All of the components may be formed of metal, such as aluminum, stainless steel or the like. For instance, the clamping body is formed of aluminum as well as the cover, while elements such as the sliding block, probe, thumb knob and lead screw may be formed of stainless steel. These parts may be appropriately cast or machined to take the form as shown in the drawings and described in the above description.

Irrespective of the effect of extreme of vibration on the tilt adjustment mechanism the screw drive provided by the lead screw sliding block combination and the dovetail connection of the sliding block to the back plate maintains the pre-set position of the probe 34, eliminating the need for periodic readjustment during use of the instrument. The greater the variation in tilt of the lower cymbal 18, the louder the sound from the two cymbals. Therefore, as the conventional mechanism loosens and the tilt angle decreases, the drummer is required to play the high-hat more aggressively to omit the same sound. The present invention eliminates that need.

In operation, the drummer may readily pre-set the angle of inclination of the lower cymbal 18 such that the axis of the lower cymbal 18, which in the untilted position is coincident with the vertical axis 20 of cymbal stand tube 12, is rendered oblique thereto. Such is achieved readily by rotation of the thumb knob 32 when turned clockwise, as in FIG. 1, causing the lead screw 30 to slowly drive the sliding block 28 vertically upwardly while maintaining the same horizontal orientation due to the engagement of the dovetail projection 80 with the dovetail guide slot 56 within the back plate 68.

The sound volume of the high-hat cymbal is adjusted based on its setting. The probe 34 is driven incrementally in accordance with the pitch of the threads on the periphery of intermediate diameter portion 96 of the lead screw and the internal threads of tapped hole 98 within the sliding block 28. The fit between head 44 of the lead screw 30 and counter-bore 88 and the fit between the reduced diameter portion 104 of thumb knob 32 and bore 90 within the bottom wall 84 of the clamp body 26 are such that rotation of the lead screw 30 is prevented even under extreme vibration as a result of playing of the instrument. Further, clamping down of the back plate or cover 68 on the left side face 40 of clamp body 26 through the four cap screws 76 with the length and width of the sliding block being nearly the same as the length and width of the rectangular cavity 66 within which the sliding block is positioned for vertical adjustment, results in increasing the friction between contacting portions of the slide block 20 and clamp body 26 at cavity 66. Rise of probe 34 from the position shown results in tilting of the lower cymbal from its horizontal orientation as shown in solid lines to an oblique position indicated by dotted line 18*a* ' through angle $\alpha$ as a typical pre-set inclination prior to the playing of the musical instrument.

While an embodiment of the invention has been described in detail, it will be evident to those skilled in the art that the invention may be embodied otherwise without departing from its spirit and scope.

What is claimed is:

1. A high-hat cymbal tilt adjustment mechanism for use with a high-hat cymbal stand including a vertically upright tubular assembly having a vertical outer tube supporting an upwardly concave lower cymbal overlying the upper end of said outer tube with the axis of the lower cymbal coincident with the axis of and bearing a vertically reciprocal internal rod for raising and lowering the upper cymbal mountable thereto, said adjustment mechanism comprising:

a body, means for fixedly mounting said body to said outer tube below the upper end of said outer tube, means defining a cavity within said body, a sliding block mounted in said cavity for movement vertically between extreme positions and including a tapped vertical hole therein, a lead screw mounted to said body for rotation about its axis and having a threaded portion threaded into said tapped vertical hole of said sliding block, and a vertically upright probe fixed to said sliding block laterally offset from an axis of said lead screw, movable therewith, and projectable vertically from a top of said body into operative contact with the lower cymbal to one side of the axis of said cymbal for tilting the cymbal relative to the axis of said tube.

2. The high-hat cymbal tilt adjustment mechanism as claimed in claim 1, wherein said cavity is of rectangular parallelepiped form wherein said sliding block is of generally rectangular plan configuration corresponding to that of said cavity and having a length and width substantially equal to the length and width respectively of said cavity, and wherein, one of said cavity and said sliding block has a horizontal dovetail projection and the other of said sliding block and cavity has a mirror image, vertical dovetail slot receiving said dovetail projection such that said dovetail projection and dovetail slot constitute vertical guide means for guiding said sliding block during vertical movement thereof within the cavity by rotation of said lead screw about its axis.

3. The high-hat cymbal tilt adjustment mechanism as claimed in claim 1, wherein said lead screw includes a axial portion projecting vertically outwardly of said block and wherein, a thumb knob is fixedly mounted to said projecting axial portion of said lead screw, whereby said lead screw may be rotated about its axis by manual rotation of said thumb knob to vary the position of the probe relative to the lower cymbal.

4. The high-hat cymbal tilt adjustment mechanism as claimed in claim 1 wherein said body is of elongated, generally parallelepiped form having front and rear parallel vertical faces, opposed right angle top and bottom faces and longitudinally opposite left and right side vertical faces, wherein said cavity is formed within one of said vertical side faces of said body and opens outwardly at said one side, centered on the longitudinal center line of said body, is of a vertical height less than a vertical height of said body, thereby defining vertically spaced top and bottom walls, wherein said body includes a back plate extending across said cavity and said one side of said body and being screwed to said body, wherein, said back plate includes a dovetail slot one the face of said back plate proximate to said body cavity and wherein said sliding block includes a dovetail projection slidably positioned within said dovetail slot of said back plate, wherein said top face includes a vertical bore rotatably mounting one end of said lead screw, wherein said to face further includes a counterbore and said lead screw includes a radially enlarged head generally sized to and fitted within said counterbore.

5. The high-hat cymbal adjustment mechanism as claimed in claim 4 wherein said bottom face comprises a cylindrical bore aligned with a cylindrical bore within the top face, wherein said lead screw includes a reduced diameter portion projecting through said bore within said bottom face, and wherein, said adjustment mechanism further comprises a cylindrical thumb knob fixedly mounted to an end of said lead screw reduced diameter portion, projecting beyond the bottom wall of said body, said thumb knob includes a portion having a diameter in excess of the bore beyond said bottom face and a reduced diameter portion of a diameter generally equal to that of said bore in said bottom face and being positioned therein, such that said radially enlarged head of said lead screw and said thumb knob function within the counter-bore within said body top wall and said bore within said body bottom wall, respectively, to prevent axial shifting of said lead screw and said thumb knob fixedly mounted thereto during rotation of the thumb knob for effecting a vertical raising the lowering of the sliding block within the cavity and a projection and retraction of the probe from said body towards and away from the lower cymbal.

6. The high-hat cymbal adjustment mechanism as claimed in claim 1 wherein said body is a clamp body including a vertical bore sized generally to an outer diameter of the cymbal stand tube for concentrically surrounding said tube, at an upper end thereof, wherein said clamp body includes a longitudinal slot extending radially from said bore receiving said cymbal stand tube and forming front and rear sections of said clamp body to a side of said clamp body opposite that bearing said cavity, and screw means, rotatably supported by one of said front and rear sections of said body at said slot, and threadedly engaging said other of said front and rear sections for drawing said sections together and reducing a width of said slot and adaptable to cause said clamp body to frictionally engage an outer periphery of said periphery of said cymbal stand tube to fix said body to said tube adjacent the upper end thereof.

7. The high-hat cymbal adjustment mechanism as claimed in claim 6 wherein said clamp body proximate to said vertical cylindrical bore receiving said cymbal stand tube is of reduced thickness over a length of said radial slot to provide flexibility to said front and rear sections of said body to permit the slot to narrow as a result of tightening down on said screw means passing through said one section and threadedly engaging the other section of said body at said slot.

* * * * *